US008915047B2

(12) United States Patent
Wilhelm et al.

(10) Patent No.: US 8,915,047 B2
(45) Date of Patent: Dec. 23, 2014

(54) BEVERAGE BOTTLE CLOSING MACHINE BEING CONFIGURED AND DISPOSED TO CLOSE TOPS OF FILLED BEVERAGE BOTTLES WITH SCREW-TYPE AND OTHER CAPS

(75) Inventors: Lothar Wilhelm, Karben (DE); Thomas Schneider, Kirn (DE); Igor Singur, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 463 days.

(21) Appl. No.: 12/791,473

(22) Filed: Jun. 1, 2010

(65) Prior Publication Data

US 2010/0307110 A1 Dec. 9, 2010

Related U.S. Application Data

(63) Continuation-in-part of application No. PCT/EP2008/009424, filed on Nov. 7, 2008.

(30) Foreign Application Priority Data

Nov. 29, 2007 (DE) ..... 10 2007 057 857

(51) Int. Cl.
*B65B 7/28* (2006.01)

(52) U.S. Cl.
USPC ..... 53/300; 53/287; 53/329; 53/485

(58) Field of Classification Search
USPC ..... 53/476–478, 484–485, 488, 490, 285, 53/287, 302, 317, 324, 329, 331, 329.2, 53/331.5, 334, 366, 300
See application file for complete search history.

(56) References Cited

U.S. PATENT DOCUMENTS

| | | | | | |
|---|---|---|---|---|---|
| 3,660,963 | A | * | 5/1972 | Sullivan | 53/488 |
| 3,771,284 | A | * | 11/1973 | Boeckmann et al. | 53/282 |
| 3,936,991 | A | | 2/1976 | Deix | |
| 4,099,361 | A | * | 7/1978 | Dix et al. | 53/488 |
| 4,104,845 | A | * | 8/1978 | Hoffmann | 53/410 |
| 4,168,599 | A | * | 9/1979 | King | 53/471 |
| 4,205,502 | A | * | 6/1980 | Ahlers | 53/308 |
| 4,511,044 | A | * | 4/1985 | Connor et al. | 209/522 |
| 4,521,807 | A | * | 6/1985 | Werson | 348/134 |
| 4,663,913 | A | * | 5/1987 | Trendel | 53/314 |
| 4,765,119 | A | * | 8/1988 | Aidlin et al. | 53/308 |
| 5,115,617 | A | * | 5/1992 | Lewis et al. | 53/306 |
| 5,218,811 | A | * | 6/1993 | LaPlante et al. | 53/331.5 |
| 5,473,855 | A | * | 12/1995 | Hidding et al. | 53/314 |
| 5,584,161 | A | * | 12/1996 | Zanini et al. | 53/317 |

(Continued)

FOREIGN PATENT DOCUMENTS

| | | | |
|---|---|---|---|
| DE | 2 408 416 | A | 8/1974 |
| DE | 198 19 612 | A1 | 11/1999 |

(Continued)

OTHER PUBLICATIONS

Russian Office Action 2010126469/12(037702).

(Continued)

*Primary Examiner* — Christopher Harmon
(74) *Attorney, Agent, or Firm* — Nils H. Ljungman & Associates

(57) ABSTRACT

A beverage bottle closing machine being configured and disposed to close tops of filled beverage bottles with screw-type and other caps.

3 Claims, 6 Drawing Sheets

(56) References Cited

U.S. PATENT DOCUMENTS

| | | | | | |
|---|---|---|---|---|---|
| 5,671,585 | A * | 9/1997 | Peronek et al. | 53/253 |
| 5,682,729 | A * | 11/1997 | Buchko | 53/453 |
| 5,778,633 | A * | 7/1998 | Sweeny | 53/201 |
| 5,778,635 | A * | 7/1998 | Galandrino | 53/306 |
| 5,816,029 | A * | 10/1998 | Sweeny | 53/490 |
| 5,839,869 | A * | 11/1998 | Moran et al. | 413/31 |
| 6,035,607 | A * | 3/2000 | Miller | 53/266.1 |
| 6,082,078 | A * | 7/2000 | Weber et al. | 53/403 |
| 6,105,343 | A * | 8/2000 | Grove et al. | 53/490 |
| 6,158,196 | A * | 12/2000 | Trebbi et al. | 53/331.5 |
| 6,167,682 | B1 * | 1/2001 | Moon | 53/489 |
| 6,341,472 | B1 * | 1/2002 | Schroeder | 53/426 |
| 6,871,482 | B2 * | 3/2005 | Cirio | 53/490 |
| 7,059,104 | B2 * | 6/2006 | Taylor | 53/471 |
| 7,299,602 | B2 * | 11/2007 | Denom et al. | 53/331 |
| 7,415,816 | B2 * | 8/2008 | Bernhard | 53/490 |
| 7,647,746 | B2 | 1/2010 | Ueda et al. | |
| 7,685,797 | B2 * | 3/2010 | Zwilling | 53/544 |
| 7,836,664 | B2 * | 11/2010 | Zanini et al. | 53/317 |
| 7,882,681 | B2 * | 2/2011 | Bernhard | 53/317 |
| 8,001,748 | B2 * | 8/2011 | Schulz et al. | 53/471 |
| 2002/0073652 | A1 * | 6/2002 | Wiedemann | 53/425 |
| 2002/0148205 | A1 * | 10/2002 | Takebe et al. | 53/490 |
| 2006/0272284 | A1 | 12/2006 | Galimberti et al. | |
| 2008/0168751 | A1 * | 7/2008 | Sink et al. | 53/490 |
| 2009/0293436 | A1 * | 12/2009 | Miyazaki et al. | 53/471 |

FOREIGN PATENT DOCUMENTS

| | | | |
|---|---|---|---|
| DE | 199 46 374 | A1 | 3/2001 |
| DE | 10 2005 018 160 | A1 | 10/2006 |
| EP | 1 182 165 | A | 2/2002 |
| EP | 1295840 | A2 | 3/2003 |
| EP | 1 757 555 | A | 2/2007 |
| FR | 2163869 | | 7/1973 |
| JP | 05065191 | A | 3/1993 |
| JP | H05278790 | A | 10/1993 |
| JP | 2000-226004 | A | 8/2000 |
| JP | 2005-138904 | A | 6/2005 |
| JP | 2005212877 | A | 8/2005 |
| JP | 2007302300 | A | 11/2007 |
| WO | WO 2005/007556 | A | 1/2005 |

OTHER PUBLICATIONS

Chinese Office Action 200880111822.X and English translation thereof.

International Search Report PCT/EP2008/009424 and English translation thereof.

German Office Action 10 2007 057 857.3-23.

* cited by examiner

BEVERAGE BOTTLE CLOSING MACHINE BEING CONFIGURED AND DISPOSED TO CLOSE TOPS OF FILLED BEVERAGE BOTTLES WITH SCREW-TYPE AND OTHER CAPS

CONTINUING APPLICATION DATA

This application is a Continuation-In-Part application of International Patent Application No. PCT/EP2008/009424, filed on Nov. 7, 2008, which claims priority from Federal Republic of Germany Patent Application No. 10 2007 057 857.3, filed on Nov. 29, 2007. International Patent Application No. PCT/EP2008/009424 was pending as of the filing date of this application. The United States was an elected state in International Patent Application No. PCT/EP2008/009424.

BACKGROUND

1. Technical Field

The present application relates to a beverage bottle closing machine being configured and disposed to close tops of filled beverage bottles with screw-type and other caps.

2. Background Information

Background information is for informational purposes only and does not necessarily admit that subsequently mentioned information and publications are prior art.

There are different designs of closing machines for closing bottles by way of screw-type closures, the screw-type closures being secured by means of being screw-connected onto or screw-connected to a bottle-side external thread in the region of the bottle mouth.

In principle, the applying of the respective closure is effected by way of a closure element or closure cone, in which the bottle closure is held until it is applied onto the bottle and which is rotatingly driveable by means of a drive for applying the closure onto the bottle or for the screw-connecting process.

On account of the geometric conditions, it may be desired during the closing process on a closure machine to alter the spacing between the bottom edge of the closing cone and the top edge of the bottle mouth, e.g. in order to compensate for the change in the spacing between the bottom edge of the cone and the bottle mouth that is produced by the screw-connecting operation. In the case of certain embodiments of closing machines, this is carried out by the bottom edge of the closing cone remaining on a vertical, substantially vertical, or essentially vertical plane, whilst the container to be closed carries out the desired movements in the vertical, substantially vertical, or essentially vertical plane.

Some closing machines, that is to say screw-type closing machines and also (crown) cap closing machines, have, on a rotor that is rotatingly driveable about a vertical, substantially vertical, or essentially vertical machine axis, a plurality of closing positions each with a closing tool and with a bottle or container support, which, with the rotor rotating, is moveable up and down in a controlled manner by means of a lifting cam for bringing together the respective bottle and the closing tool before the closing operation and for separating the closed bottle and the closing tool.

The loading of the bottles during the screw-connecting operation is achieved in the case of some closing machines, for example, by raising the bottle support.

In the case of another embodiment of some closing machines, the container to be closed remains on a vertical, substantially vertical, or essentially vertical plane, whereas the closing cone carries out the desired movements in the vertical, substantially vertical, or essentially vertical plane or in the vertical, substantially vertical, or essentially vertical direction.

In some closing machines, both the container and the closing cone carry out a part of the desired movements in the vertical, substantially vertical, or essentially vertical plane.

Some closing machines close containers by a closure, for example a crown cap, being deformed in a malleable manner by means of a targeted application of force, thereby closing the container to be closed. In the case of these types of closing machines also, there has to be or may be a modification of the spacing between the container mouth and the closing cone. The rotational movement desired in the case of screw-type closures is omitted.

In the case of some closing machines, desired movements are realized in the vertical, substantially vertical, or essentially vertical plane by means of a combination between a usually fixed lifting cam and touching elements, which slide or roll off the lifting cam and pick up the substantially vertical, or essentially vertical movement of the lifting cam and transmit it to the components moving in the vertical, substantially vertical, or essentially vertical plane.

A limitation of these types of lifting cam drives is that once they have been manufactured they cannot be changed in a flexible manner, which means that even the smallest changes in the desired course of movement in the vertical, substantially vertical, or essentially vertical plane make the production of a new lifting cam desired.

Another limitation is that these types of lifting cams wear relatively quickly and consequently have to be replaced after a certain number of operating hours. As the lifting cams, usually, are also located in the substructure of the closing machine, a replacement is very complicated and costly, which is also undesirable in practice.

The present application relates to a closing machine for closing bottles or similar containers with closures. The closing machine comprises a plurality of closing stations that are formed at the periphery of a rotor that is driveable in a rotating manner about a machine axis. The closing machine also comprises a container support and a closing tool, wherein, for accomplishing the vertical, substantially vertical, or essentially vertical movements desired for the closing operation, a separate, controlled or regulated drive motor is located at each closing station.

OBJECT OR OBJECTS

It is an object and aim of the present application to minimize the above-discussed limitations.

SUMMARY

To this end, the present application provides the embodiment of closing machines where the limitations of some lifting cam drives are minimized. To this end, the application of a controlled or regulated drive for realizing the desired vertical, substantially vertical, or essentially vertical movements is proposed.

A corresponding closing machine disclosed in the present application is a machine for closing bottles or similar containers with closures. The closing machine comprises a plurality of closing stations that are formed at the periphery of a rotor that is driveable in a rotating manner about a machine axis. The closing machine also comprises a container support and a closing tool, wherein a separate, controlled or regulated drive motor for accomplishing the vertical movements necessary for the closing operation is located at each closing station.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The present application is explained below by way of the figures of possible embodiments, in which, in detail.

DESCRIPTION OF EMBODIMENT OR EMBODIMENTS

Figure 1:
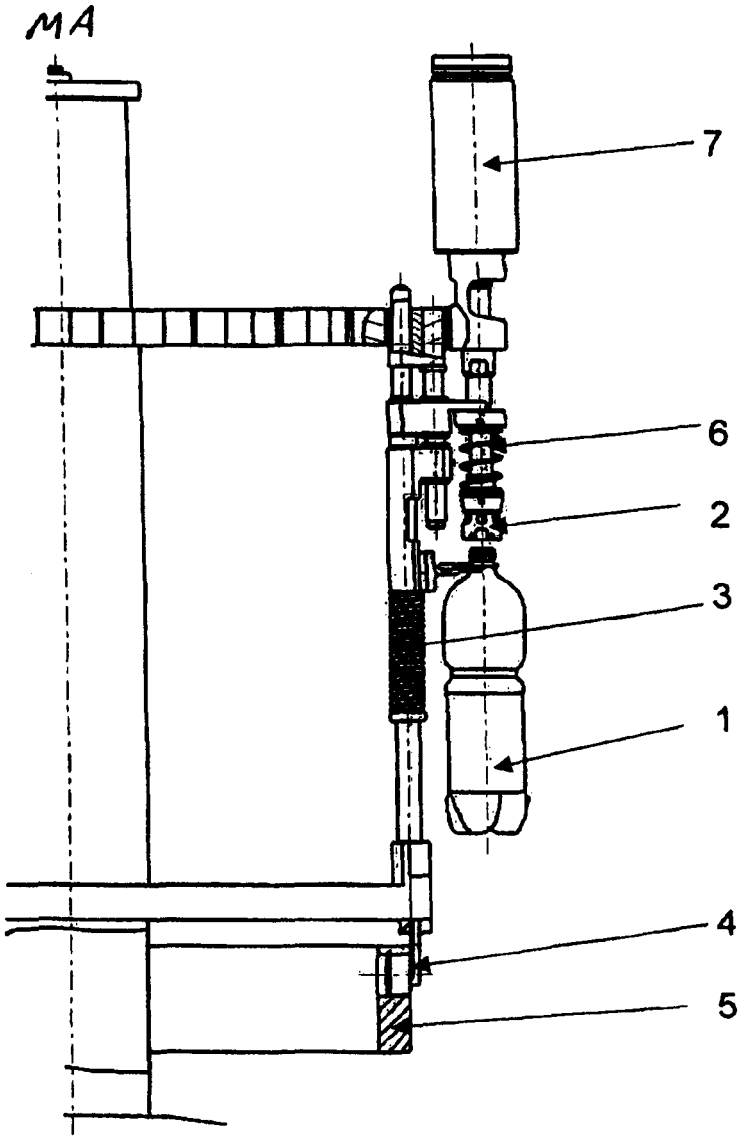
PRIOR ART FIG. 1
FIG. 1 shows a closing machine corresponding to the prior art.

A closing machine corresponding to the prior art is represented in FIG. 1. The container 1 to be closed, in the example represented a bottle with a neck ring and a screw-type closure, is situated directly below the closing cone 2. The container 1 to be closed is secured at a lifting rod 3, which is moveable in the vertical, substantially vertical, or essentially vertical direction and which, by means of a roller 4, abuts in a permanent or virtually permanent manner under initial spring tension against the lifting cam 5. By means of this arrangement, the container 1 to be closed and rotating about the machine axis MA follows the vertical, substantially vertical, or essentially vertical course of the bearing surface of the lifting cam 5.

In the example represented, a screw-type spindle 6, which is driven by a controlled or regulated drive motor 7, is provided for closing the container 1.

In one possible embodiment of the present application, what may be meant by the term "controlled or regulated drive motor" may possibly refer to such a drive motor where it is possible to control or regulate the speed of the drive motor, the angle of rotation of the drive motor, the overall angle of rotation of the drive motor, the torque of the drive motor, the angular acceleration of the drive motor, and the angular deceleration of the drive motor, amongst other things. Some embodiments of controlled or regulated drive motors may comprise, for example, servo motors or stepping motors.

Figure 2:
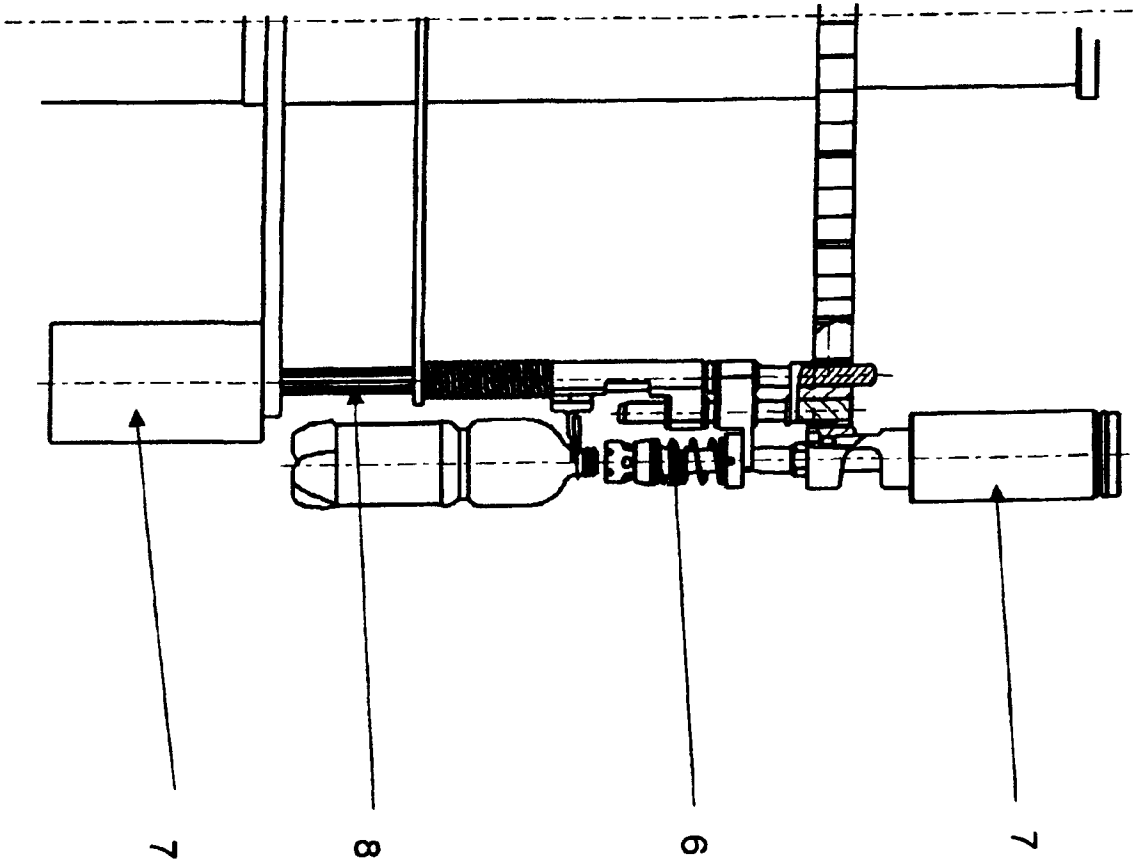
FIG. 2 shows a component drawing and partial section of one of the closing stations of a closing machine according to the present application, said closing machine designed to use screw-type closures.

FIG. 2 shows a closing machine according to the present application that is designed to use screw-type closures. The lifting cam drive, which can be seen in FIG. 1, for the vertical, substantially vertical, or essentially vertical movements has been replaced, corresponding to the teaching of the present application, by a controlled or regulated drive motor 7, in at least one possible embodiment, provided separately for each closing station with associated movement member, for example a threaded spindle 8.

Other devices similar to the threaded spindle 8 for creating and/or producing a controlled or regulated linear movement may possibly also be used in at least one possible embodiment of the present application. In this case, as an example but not in a limiting manner, a belt drive and/or a rack-and-pinion drive may possibly be used in at least one embodiment.

Each drive motor 7 is, in at least one possible embodiment of the present application, provided with a rotary encoder or a position measuring means for the lift movement.

The present application makes it possible to develop the vertical, substantially vertical, or essentially vertical movements desired for the closing operation, that is to say the screw-type closing operation or also the crown cap closing operation, in a freely programmable manner.

Consequently, in a simple manner, it is possible to adapt the vertical, substantially vertical, or essentially vertical movements of each individual closing station, and consequently also to adapt the vertical, substantially vertical, or essentially vertical movements of the entire closing machine, at the touch of a button as it were to different circumstances, uses, or situations. Such changes may be desired, for example, in at least one possible embodiment utilizing other types of bottles with screw-type closures that are of a different length. Further changes may be desired, however, with a change in the closure used, for example with a change from a standard screw-type closure to a so-called sport cap closure.

As described above, the individual closing stations rotate with the closing machine about the machine axis MA, the container mouth and/or the closure cone or closing tool having to assume other vertical, substantially vertical, or essentially vertical positions during a cycle about the machine axis MA in dependence on the current angular position within a cycle. This desired movement profile is deposited in the machine control means for every application to be expected and can be called on there by the machine operator, thereby essentially completing the changeover to the new conditions or circumstances.

Figure 3:
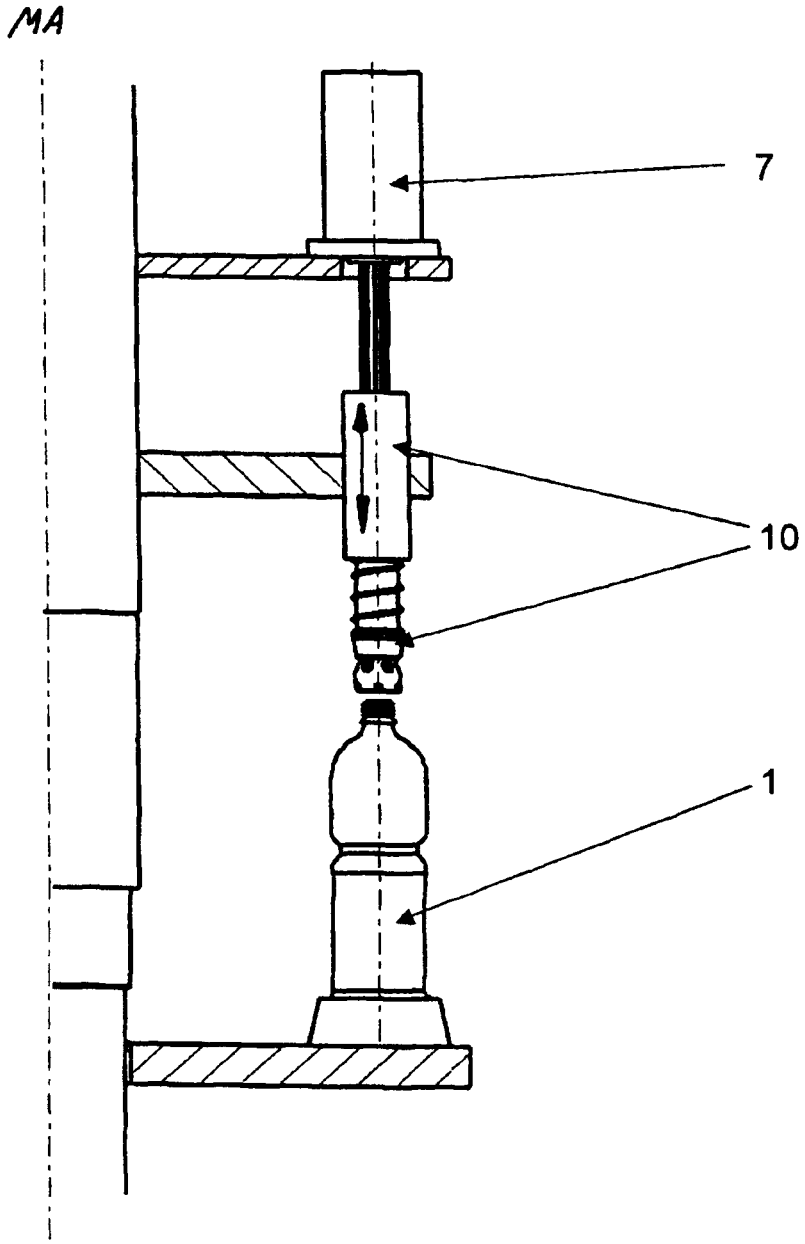
FIG. 3 shows a component drawing and part section of one of the closing stations of a closing machine according to the present application, said closing machine designed to use (crown) caps.

FIG. 3 shows a closing machine according to the present application, designed to use (crown) caps. Contrary to the possible embodiment in FIG. 2, this case deals with a closing machine where the container 1 is closed by means of a closure that is to be deformed in a malleable manner, for example a crown cap 9.

In the case of such types of closing machines, realizing the desired vertical, substantially vertical, or essentially vertical movement of the closing ram 10 by means of a lifting cam, like that which is shown in FIG. 1.

According to the present application, the realizing of the vertical, substantially vertical, or essentially vertical movement of the closing ram 10 is provided by means of a controlled or regulated drive motor 7 in conjunction with a suitable linear movement member, for example a threaded spindle 8.

With regard to the additional technical teaching and the embodiments produced through the application of the same, what is said above is applicable in an analogous manner.

Figure 4:
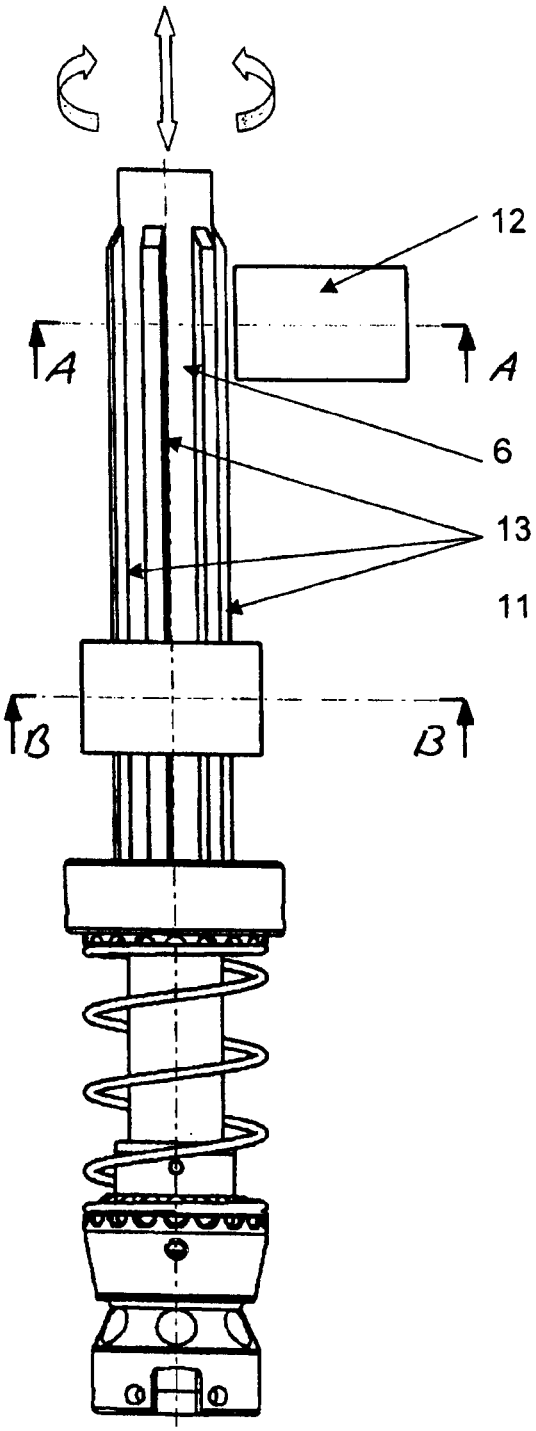
FIG. 4 shows a partial representation of a top view of a further development of the present application where linear drives are used.
Figure 4A:
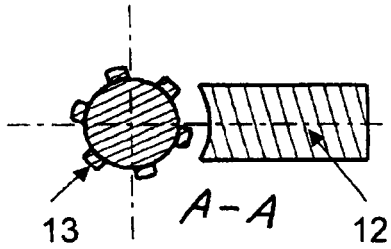
Figure 4B:
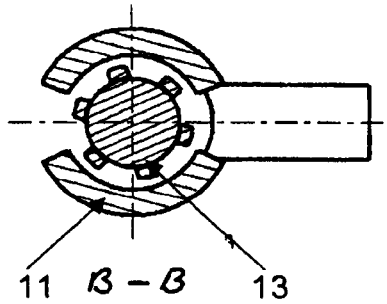

FIG. 4 shows another possible embodiment of the present application.

In this possible embodiment, linear motors (traveling-field machines) are used for the lifting and/or rotational movement at each closing station. Such types of linear motors or traveling-field machines are sufficiently known to the expert so that the aspects relevant to the present application need to be explained in more detail at this point.

Linear motors usually comprise a fixed stator that includes the exciting windings and by a moveable armature. In this case, the moveable armature is able to carry out rotational movements and/or translatory movements.

According to the present application it is provided that the screw-type spindle 8 of a screw-type closing machine, or the closing ram 10 of a (crown) cap is realized as an armature.

To this end, screw-type spindles 6 or closing rams 10 are designed such that they have the desired magnets 13 as are desired to generate the linear and/or rotational movements.

First, a stator 11 is located at the periphery of a screw-type spindle 6 to generate a rotational movement. Through a suitable arrangement and actuation of the exciting windings that are included in said stator, it is possible to generate the desired rotational movements.

In addition, a further stator 12 is located at the periphery of the screw-type spindle 6 to generate a linear movement. The additional stator works, for example, on magnets inside or at the periphery of the screw-type spindle 6, which have different polarity or orientation in the vertical, substantially vertical, or essentially vertical direction.

Figure 5:
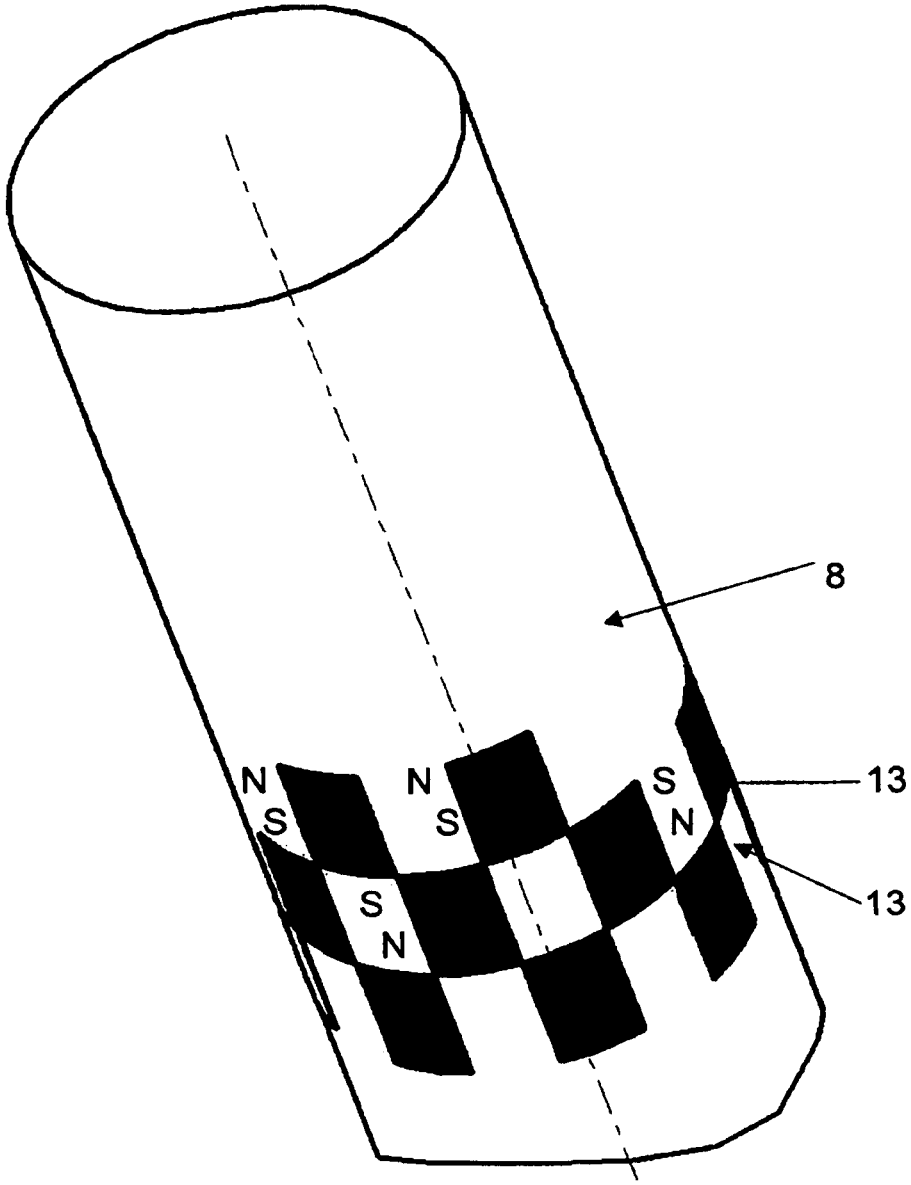
FIG. 5 shows a general layout drawing of a possible arrangement of magnets with different polarity.

By arranging a plurality of magnets in the screw-type spindle 6 in a clever manner, for example in an alternating arrangement of magnets 6 of different polarity or orientation, both vertically, substantially vertically, or essentially vertically and also with reference to the periphery of the screw-type spindle 6, for example in a chessboard-shaped arrangement as seen in FIG. 5, translatory as well as rotational movements of the screw-type spindle 6 can be generated in conjunction with the stators 11 and 12, both one after the other and at the same time.

In the case of a closing machine designed to use (crown) caps, the arrangement of a linear motor for the accomplishment of the translatory movement is sufficient.

The teaching of the present application also extends to such developments where the desired vertical, substantially vertical, or essentially vertical movements are carried out at least partially by the container 1 and/or at least partially by the screw-type spindle 6 and/or at least partially by the closing ram 10.

The extent of the present application also extends to heat sealing machines, heat sealing machines also being used to close containers. These machines are usually designed substantially in the same manner as (crown) capping machines.

Figure 6:
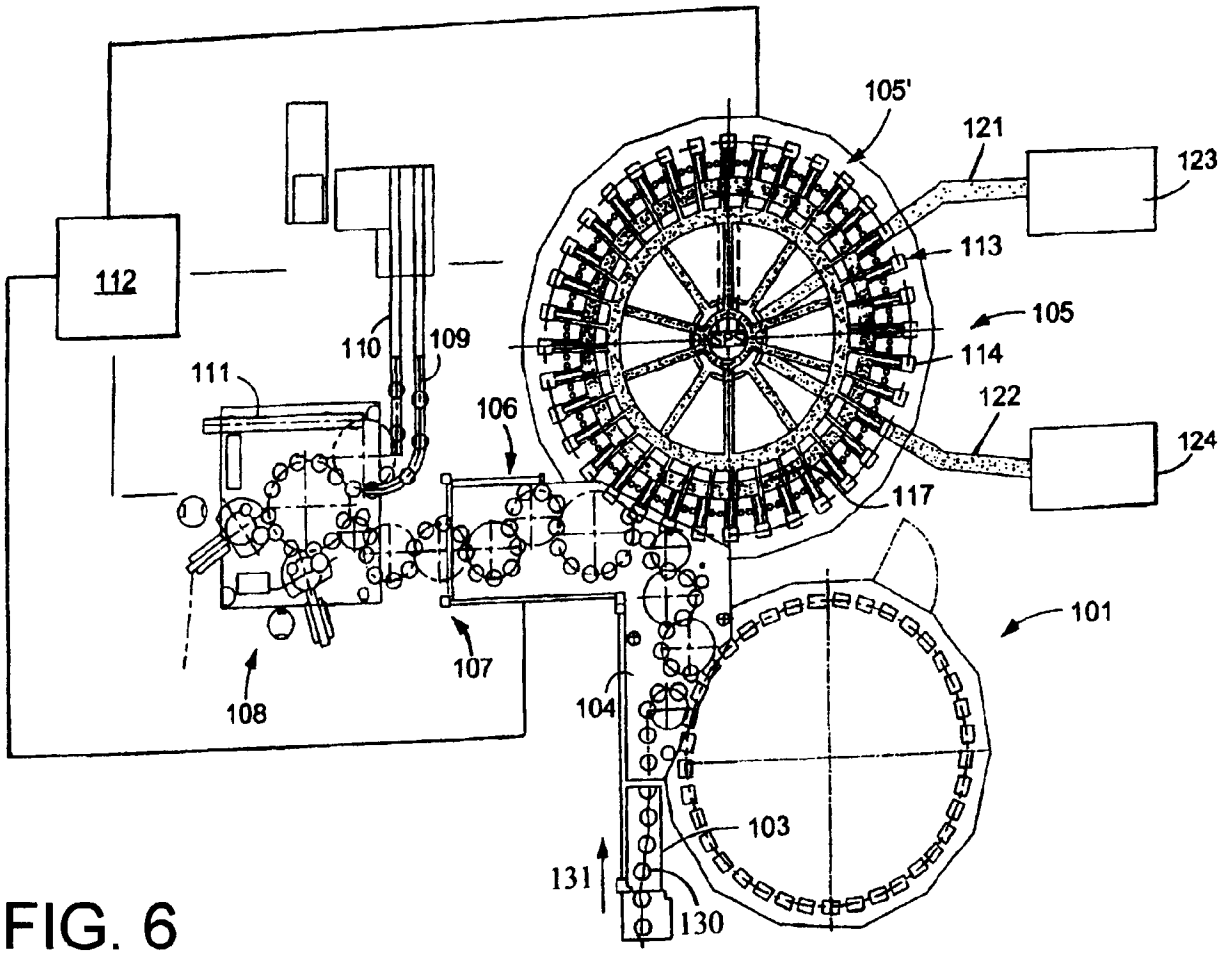
FIG. 6 shows schematically the main components of one possible embodiment example of a system for filling containers, for example, a beverage bottling plant for filling bottles with at least one liquid beverage, in accordance with at least one possible embodiment, in which system or plant could possibly be utilized at least one aspect, or several aspects, of the embodiments disclosed herein.

FIG. 6 shows schematically the main components of one possible embodiment example of a system for filling containers, specifically, a beverage bottling plant for filling bottles 130 with at least one liquid beverage, in accordance with at least one possible embodiment, in which system or plant could possibly be utilized at least one aspect, or several aspects, of the embodiments disclosed herein.

FIG. 6 shows a rinsing arrangement or rinsing station 101, to which the containers, namely bottles 130, are fed in the direction of travel as indicated by the arrow 131, by a first conveyer arrangement 103, which can be a linear conveyor or a combination of a linear conveyor and a starwheel. Downstream of the rinsing arrangement or rinsing station 101, in the direction of travel as indicated by the arrow 131, the rinsed bottles 130 are transported to a beverage filling machine 105 by a second conveyer arrangement 104 that is formed, for example, by one or more starwheels that introduce bottles 130 into the beverage filling machine 105.

The beverage filling machine 105 shown is of a revolving or rotary design, with a rotor 105', which revolves around a central, vertical machine axis. The rotor 105' is designed to receive and hold the bottles 130 for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles 130 to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 6, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle 130, the first product or the second product can be filled by means of an appropriate control of the filling product or fluid valves.

Downstream of the beverage filling machine 105, in the direction of travel of the bottles 130, there can be a beverage bottle closing arrangement or closing station 106 which closes or caps the bottles 130. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles 130. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles 130 to different locations.

The first output conveyer arrangement 109, in the embodiment shown, is designed to convey bottles 130 that are filled with a first type of liquid beverage supplied by, for example, the supply reservoir 123. The second output conveyer arrangement 110, in the embodiment shown, is designed to convey bottles 130 that are filled with a second type of liquid beverage supplied by, for example, the supply reservoir 124. The third output conveyer arrangement 111, in the embodiment shown, is designed to convey incorrectly labeled bottles 130. To further explain, the labeling arrangement 108 can comprise at least one beverage bottle inspection or monitoring device that inspects or monitors the location of labels on the bottles 130 to determine if the labels have been correctly placed or aligned on the bottles 130. The third output conveyer arrangement 111 removes any bottles 130 which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

The present application relates to a machine for closing bottles or similar containers with closures. The closing machine comprises closing stations with a container carrier and a closing tool and formed at the circumference of a rotor that can be driven to rotate about a vertical, substantially vertical, or essentially vertical machine axis MA. According to the present application, a separate, controlled drive motor is provided at each closing station for executing the vertical, substantially vertical, or essentially vertical movement desired for the closing process.

One feature or aspect of an embodiment is believed at the time of the filing of this patent application to possibly reside broadly in a machine for closing bottles or similar containers with closures, said machine having a plurality of closing stations that are formed at the periphery of a rotor that is driveable in a rotating manner about a machine axis MA, and having a container support and a closing tool, wherein for accomplishing the vertical, substantially vertical, or essentially vertical movements desired for the closing operation, a separate, controlled or regulated drive motor 7 is located at each closing station.

Another feature or aspect of an embodiment is believed at the time of the filing of this patent application to possibly reside broadly in the machine, wherein the machine is designed as a closing machine that uses (crown) caps.

Yet another feature or aspect of an embodiment is believed at the time of the filing of this patent application to possibly reside broadly in the machine, wherein the machine is a heat sealing machine.

Still another feature or aspect of an embodiment is believed at the time of the filing of this patent application to possibly reside broadly in the machine according to the present application, wherein the controlled or regulated drive motor 7 works on a threaded spindle 8 and/or a belt drive and/or a rack-and-pinion drive.

A further feature or aspect of an embodiment is believed at the time of the filing of this patent application to possibly reside broadly in the machine according to the present application, wherein the controlled or regulated drive motor 7 is a servo motor or stepping motor.

Another feature or aspect of an embodiment is believed at the time of the filing of this patent application to possibly reside broadly in the machine according to the present application, wherein the controlled or regulated drive motor 7 is a linear motor.

Yet another feature or aspect of an embodiment is believed at the time of the filing of this patent application to possibly reside broadly in the machine according to the present application, wherein the vertical, substantially vertical, or essentially vertical positions of container mouth and/or screw-type spindle 6 and/or closing ram 10 of the individual closing stations during a cycle about the machine axis MA, in dependence on the current angular position inside a cycle, are deposited in the machine controlling means so as to be retrievable as a desired movement profile.

Still another feature or aspect of an embodiment is believed at the time of the filing of this patent application to possibly reside broadly in the machine according to the present application, wherein the closing ram 10 is realized at least partially as a linearly-moving armature of a linear motor.

A further feature or aspect of an embodiment is believed at the time of the filing of this patent application to possibly reside broadly in the machine according to the present application, wherein the machine is a closing machine that is designed to use screw-type closures.

Another feature or aspect of an embodiment is believed at the time of the filing of this patent application to possibly reside broadly in the machine, wherein at least one further drive is arranged for the screw-type movement in addition to the controlled or regulated drive motor 7 for the vertical, substantially vertical, or essentially vertical movement.

Yet another feature or aspect of an embodiment is believed at the time of the filing of this patent application to possibly reside broadly in the machine according to the present application, wherein the screw-type spindle 6 is realized at least partially as a linearly-moving armature of a linear motor and at least partially as a rotatingly-moving rotor of a linear motor.

Another feature or aspect of an embodiment is believed at the time of the filing of this patent application to possibly reside broadly in the machine according to the present application, wherein the container mouth carries out at least one part of the desired vertical, substantially vertical, or essentially vertical movement.

Yet another feature or aspect of an embodiment is believed at the time of the filing of this patent application to possibly reside broadly in the machine according to the present application, wherein the closing tool 6, 11 carries out at least one part of the desired vertical, substantially vertical, or essentially vertical movement. The components disclosed in the various publications, disclosed or incorporated by reference herein, may possibly be used in possible embodiments of the present invention, as well as equivalents thereof.

Still another feature or aspect of an embodiment is believed at the time of the filing of this patent application to possibly reside broadly in a beverage bottle closing machine being configured and disposed to close tops of filled beverage bottles with screw-type caps, in a beverage bottle filling plant, said beverage bottle closing machine comprising: a rotor; a rotatable vertical machine column; said rotor being connected to said vertical machine column to permit rotation of said rotor about said vertical machine column; a plurality of closing stations being disposed on the periphery of said rotor; each of said plurality of closing stations being configured and disposed to place screw-type caps on filled beverage bottles and close filled beverage bottles; each of said plurality of closing stations comprising: a closing tool being configured and disposed to place screw-type caps on filled beverage bottles and being configured to close filled beverage bottles;

a container carrier being configured and disposed to receive and hold filled beverage bottles; a first threaded spindle being connected to said container carrier; said first threaded spindle being configured and disposed to vertically move said container carrier and a filled beverage bottle with respect to said closing tool during operation of said beverage bottle closing machine; a first rotatable electric motor being connected to said first threaded spindle; said first rotatable electric motor being configured and disposed to rotate said first threaded spindle and move said container carrier; said first rotatable electric motor being configured and disposed to control the vertical movement of said container carrier during operation of said beverage bottle closing machine; a second threaded spindle being connected to said closing tool; said second threaded spindle being configured and disposed to rotationally move and being configured close filled beverage bottles with screw-type caps; a second rotatable electric motor being connected to said second threaded spindle; said second rotatable electric motor being configured and disposed to control the rotational movement of said second threaded spindle during operation of said beverage bottle closing machine.

A further feature or aspect of an embodiment is believed at the time of the filing of this patent application to possibly reside broadly in the beverage bottle closing machine, wherein: said first rotatable electric motor comprises a servo motor or stepping motor; and said second rotatable electric motor comprises a servo motor or stepping motor.

Another feature or aspect of an embodiment is believed at the time of the filing of this patent application to possibly reside broadly in the beverage bottle closing machine, wherein the vertical positions of a container mouth and/or said second threaded spindle of each of said plurality of closing stations during a cycle about said rotatable vertical machine column, in dependence on the current angular position inside a cycle, are deposited in the machine controlling means so as to be retrievable as a required movement profile.

Yet another feature or aspect of an embodiment is believed at the time of the filing of this patent application to possibly reside broadly in the beverage bottle closing machine, wherein said closing tool is configured to move vertically with respect to said container carrier during operation of said beverage bottle closing machine.

One feature or aspect of an embodiment is believed at the time of the filing of this patent application to possibly reside broadly in a beverage bottle closing machine being configured and disposed to close tops of filled beverage bottles with screw-type caps, in a beverage bottle filling plant, said beverage bottle closing machine comprising: a rotor; a rotatable vertical machine column; said rotor being connected to said vertical machine column to permit rotation of said rotor about said vertical machine column; a plurality of closing stations being disposed on the periphery of said rotor; each of said plurality of closing stations being configured and disposed to place screw-type caps on filled beverage bottles and close filled beverage bottles; each of said plurality of closing stations comprising: a closing tool being configured and disposed to place screw-type caps on filled beverage bottles and being configured to close filled beverage bottles; a container carrier being configured and disposed to receive and hold filled beverage bottles; a first threaded rotatable spindle being connected to said container carrier; said first threaded rotatable spindle being configured and disposed to vertically move said container carrier and a filled beverage bottle with respect to said closing tool during operation of said beverage bottle closing machine; a first rotatable electric motor being connected to said first threaded rotatable spindle; said first rotatable electric motor being configured to be controllable or regulatable by a controller configured to control: the speed of said first rotatable electric motor, the angle of rotation of said first rotatable electric motor, the overall angle of rotation of said first rotatable electric motor, the torque of said first rotatable electric motor, the angular acceleration of said first rotatable electric motor, and the angular deceleration of said first rotatable electric motor; said first rotatable electric motor comprising a controller being configured and disposed to control or regulate: the speed of said first rotatable electric motor, the angle of rotation of said first rotatable electric motor, the overall angle of rotation of said first rotatable electric motor, the torque of said first rotatable electric motor, the angular acceleration of said first rotatable electric motor, and the angular deceleration of said first rotatable electric motor; said first rotatable electric motor being configured and disposed to rotate said first threaded rotatable spindle and move said container carrier; said first rotatable electric motor being configured and disposed to control the vertical movement of said container carrier during operation of said beverage bottle closing machine; a second threaded rotatable spindle being connected to said closing tool; a second rotatable electric motor being connected to said second threaded rotatable spindle; said second rotatable electric motor being configured to be controllable or regulatable by a controller configured to control: the speed of said second rotatable electric motor, the angle of rotation of said second rotatable electric motor, the overall angle of rotation of said second rotatable electric motor, the torque of said second rotatable electric motor, the angular acceleration of said second rotatable electric motor, and the angular deceleration of said second rotatable electric motor; said second rotatable electric motor comprising a controller being configured and disposed to control or regulate: the speed of said second rotatable electric motor, the angle of rotation of said second rotatable electric motor, the overall angle of rotation of said second rotatable electric motor, the torque of said second rotatable electric motor, the angular acceleration of said second rotatable electric motor, and the angular deceleration of said second rotatable electric motor; said second threaded rotatable spindle being configured and disposed to be rotationally moved by said second rotatable electric motor and being configured to rotate said closing tool and being configured to close filled beverage bottles with screw-type caps during operation of said beverage bottle closing machine.

Another feature or aspect of an embodiment is believed at the time of the filing of this patent application to possibly reside broadly in the machine, wherein one of (A) and (B): (A) the controlled or regulated drive motor 7 is a servo motor or stepping motor; and (B) the controlled or regulated drive motor 7 is a linear motor.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein except for the exceptions indicated herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of methods and apparatuses for closing bottles and containers and their components that may possibly be utilized or possibly adapted for use in at least one possible embodiment of the present application may possibly be found in the following U.S. Pat. No. 5,398,485 issued to Osifchin on Mar. 21, 1995; U.S. Pat. No. 5,402,623 issued to Ahlers on Apr. 4, 1995; U.S. Pat. No. 5,419,094 issued to Vander Bush, Jr. et al. on May 30, 1995; U.S. Pat. No. 5,425,402 issued to Pringle on Jun. 20, 1995; U.S. Pat. No. 5,447,246 issued to Finke on Sep. 5, 1995; and U.S. Pat. No. 5,449,080 issued to Finke on Sep. 12, 1995.

Some examples of stepping motors that may possibly be utilized or possibly adapted for use in at least one possible embodiment of the present application may possibly be found in the following U.S. Pat. No. 6,348,774 issued to Andersen et al. on Feb. 19, 2002; U.S. Pat. No. 6,373,209 issued to Gerber et al. on Apr. 16, 2002; U.S. Pat. No. 6,424,061 issued to Fukuda et al. on Jul. 23, 2002; U.S. Pat. No. 6,509,663 issued to Aoun on Jan. 21, 2003; U.S. Pat. No. 6,548,923 to Ohnishi et al. on Apr. 15, 2003; and U.S. Pat. No. 6,661,193 issued to Tsai on Dec. 9, 2003.

Some examples of servo-motors that may possibly be utilized or possibly adapted for use in at least one possible embodiment of the present application may possibly be found in the following U.S. Pat. No. 4,050,434 issued to Zbikowski et al. on Sep. 27, 1977; U.S. Pat. No. 4,365,538 issued to Andoh on Dec. 28, 1982; U.S. Pat. No. 4,550,626 issued to Brouter on Nov. 5, 1985; U.S. Pat. No. 4,760,699 issued to Jacobsen et al. on Aug. 2, 1988; U.S. Pat. No. 5,076,568 issued to de Jong et al. on Dec. 31, 1991; and U.S. Pat. No. 6,025,684 issued to Yasui on Feb. 15, 2000.

Some examples of synchronous motors which may possibly be utilized or adapted for use in at least one possible embodiment may possibly be found in the following U.S. Pat. No. 6,713,899, entitled "Linear synchronous motor;" U.S. Pat. No. 6,486,581, entitled "Interior permanent magnet synchronous motor;" U.S. Pat. No. 6,424,114, entitled "Synchronous motor;" U.S. Pat. No. 6,388,353, entitled "Elongated permanent magnet synchronous motor;" U.S. Pat. No. 6,329,728, entitled "Cylinder-type linear synchronous motor;" U.S. Pat. No. 6,025,659, entitled "Synchronous motor with movable part having permanent magnets;" U.S. Pat. No. 5,936,322, entitled "Permanent magnet type synchronous motor;" and U.S. Pat. No. 5,448,123, entitled "Electric synchronous motor."

Some examples of lifting devices that may possibly be utilized or possibly adapted for use in at least one possible embodiment of the present application may possibly be found in the following patent publications: U.S. Pat. No. 2,535,272 issued to Detrez on Dec. 26, 1950; U.S. Pat. No. 2,642,214 issued to Lippold on Jun. 16, 1953; German Utility Model No. DE-GM 1,923,261 issued on Sep. 9, 1965; German Laid Open Patent Application No. DE-OS 1,532,586 published on Oct. 2, 1969; British Patent No. 1,188,888 issued Apr. 22, 1970; German Laid Open Patent Application No. DE-OS 26 52 910 published on May 24, 1978; German Patent No. DE-PS 26 52 918 issued on Oct. 26, 1978; German Utility Model No. DE-GM 83 04 995 issued on Dec. 22, 1983; German Patent No. DE-PS 26 30 100 issued on Dec. 3, 1981; and German Laid Open Patent Application No. DE-OS 195 45 080 published on Jun. 5, 1997.

Some examples of linear drives that may possibly be utilized or possibly adapted for use in at least one possible embodiment of the present application may possibly be found in the following U.S. Pat. No. 7,649,285 issued to Ueda on Jan. 19, 2010; No. D596,652 issued to Roither, et al. on Jul. 21, 2009; U.S. Pat. No. 7,528,561 issued to Kawai, et al. on May 5, 2009; U.S. Pat. No. 6,992,408 issued to Finkbeiner, et al. on Jan. 31, 2006; U.S. Pat. No. 7,064,464 issued to Ickinger on Jun. 20, 2006; and U.S. Pat. No. 7,055,423 issued to Stoll, et al. on Jun. 6, 2006.

Some examples of heat sealing machines, which may possibly be utilized or possibly adapted for use in at least one possible embodiment of the present application, may possibly be found in the following U.S. Pat. No. 7,528,352, having the title "INDUCTION SEALER SYSTEM WITH TEMPERATURE SENSOR," published on May 5, 2009; U.S. Pat. No. 7,065,941, having the title "INDUCTION FOIL CAP SEALER," published on Jun. 27, 2006; U.S. Pat. No. 5,432,437, having the title "EXPOSURE METER FOR USE WITH INDUCTION HEAT SEALING OF CONTAINERS," published on Jul. 11, 1995; U.S. Pat. No. 4,613,746, having the title "METHOD AND APPARATUS FOR AUTOMATICALLY CONTROLLING THE TEMPERATURE OF A HEATER ELEMENT," published on Sep. 23, 1986; U.S. Pat. No. 4,176,507, having the title "CONDIMENT PACKAGING MACHINE," published on Dec. 4, 1979; Re. 29,448, having the title "METHOD AND APPARATUS FOR ASSEMBLING AND JOINING THERMOPLASTIC CONTAINER SECTIONS BY FRICTION WELDING," reissued on Oct. 18, 1977; and U.S. Pat. No. 3,645,825, having the title "APPARATUS FOR SEALING THIN WALLED CONTAINERS," published on Feb. 29, 1972.

All of the patents, patent applications or patent publications, except for the exceptions indicated herein, which were cited in the International Search Report dated Mar. 31, 2009 and/or cited elsewhere are hereby incorporated by reference as if set forth in their entirety herein, as follows: EP 1 182 165 A1, having the title "Capping head with linear motor actuator," published on Feb. 27, 2002; WO 2005/007556 A1, having the title "A CAPPING UNIT FOR CLOSING CONTAINERS WITH RESPECTIVE CAPS," published on Jan. 27, 2005; DE 198 19 612 A1, having the following German title "Verschlieβelement für eine Verschlieβmaschine," published on Nov. 11, 1999; and EP 1 757 555 A1, having the title "CAPPER HEAD," published on Feb. 28, 2007.

All of the patents, patent applications or patent publications, German Office Action dated Oct. 16, 2008 and/or cited elsewhere are hereby incorporated by reference as if set forth in their entirety herein, as follows: JP 5065191 A, having the translated English title "DEVICE FOR LIFTING CAPPING HEAD OF CAPPER," published on Mar. 19, 1993; DE 10 2005 018 160 A1, having the following German title "Verschlieβmaschine für runde and unrunde Metallverpackungen," published on Oct. 26, 2006; DE 199 46 374 A1, having the following German title "Vorrichtung zum Verschlieβen von Behältnissen," published on Mar. 29, 2001; and DE 2 408 416 A, having the following German title "Vorrichtung zum Verschlieβen von Behälteröffnungen," published on Aug. 29, 1974.

The patents, patent applications, and patent publications listed above in the preceding paragraphs are herein incorporated by reference as if set forth in their entirety except for the exceptions indicated herein. The purpose of incorporating U.S. patents, Foreign patents, publications, etc. is solely to provide additional information relating to technical features of one or more embodiments, which information may not be completely disclosed in the wording in the pages of this application. However, words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned words in this sentence, when not used to describe technical features of one or more embodiments of the patents, patent applications, and patent publications, are not considered to be incorporated by reference herein.

The corresponding foreign and international patent publication applications, namely, Federal Republic of Germany Patent Application No. 10 2007 057 857.3, filed on Nov. 29, 2007, having inventors Lothar WILHELM, Thomas SCHNEIDER, and Igor SINGUR, and DE-OS 10 2007 057 857.3 and DE-PS 10 2007 057 857.3, and International Application No. PCT/EP2008/009424, filed on Nov. 7, 2008, having WIPO Publication No. WO 2009/068166 A1 and inventors Lothar WILHELM, Thomas SCHNEIDER, and Igor SINGUR, are hereby incorporated by reference as if set forth in their entirety herein, except for the exceptions indicated herein, for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, except for the exceptions indicated herein, are hereby incorporated by reference as if set forth in their entirety herein.

The purpose of incorporating the corresponding foreign equivalent patent applications, that is, PCT/EP2008/009424 and German Patent Application DE 10 2007 057 857.3, is solely for the purpose of providing a basis of correction of any wording in the pages of the present application, which may have been mistranslated or misinterpreted by the translator. However, words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned word in this sentence, when not used to describe technical features of one or more embodiments of the patents, patent applications, and patent publications, are not generally considered to be incorporated by reference herein.

Statements made in the original foreign patent applications PCT/EP2008/009424 and DE 10 2007 057 857.3 from which this patent application claims priority which do not have to do with the correction of the translation in this patent application are not to be included in this patent application in the incorporation by reference.

Any statements about admissions of prior art in the original foreign patent applications PCT/EP2008/009424 and DE 10 2007 057 857.3 are not to be included in this patent application in the incorporation by reference, since the laws relating to prior art in non-U.S. Patent Offices and courts may be substantially different from the Patent Laws of the United States.

All of the references and documents cited in any of the documents cited herein, except for the exceptions indicated herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A rotary container closing machine comprising:

a rotor and a plurality of closing arrangements disposed around the periphery of said rotor;

each of said closing arrangements comprising a container support, a closing device, and an electric drive motor arrangement;

said electric drive motor arrangement being configured to vertically move its container support in a container closing operation;

said electric drive motor arrangement comprises a linear motor; and said linear motor comprises an armature and a stator arrangement configured to vertically and linearly move said armature directly by electromagnetic force on said armature, on which armature said container support is mounted.

2. The rotary container closing machine as claimed in claim 1, wherein:

said armature comprises an elongated body having a central axis; and said stator arrangement is configured to solely generate a linear movement of said armature along said central axis.

3. The rotary container closing machine as claimed in claim 2, wherein:

said electric drive motor arrangement is configured to move its closing device in a container closing operation;

said electric drive motor arrangement comprises an additional linear motor; and said additional linear motor comprises an armature and a stator arrangement configured to move said armature directly by electromagnetic force on said armature, on which armature said closing device is mounted.

* * * * *